US010400420B2

(12) United States Patent
Stonum

(10) Patent No.: US 10,400,420 B2
(45) Date of Patent: Sep. 3, 2019

(54) TILT AND HEIGHT ADJUSTMENT MECHANISM FOR IMPLEMENT

(71) Applicant: Durabuilt Industries, LLC, Pocahontas, AR (US)

(72) Inventor: Scott Thomas Stonum, St. Peters, MO (US)

(73) Assignee: DURABILT INDUSTRIES, LLC, Pocahontas, AR (US)

( * ) Notice: Subject to any disclaimer, the term of this patent is extended or adjusted under 35 U.S.C. 154(b) by 379 days.

(21) Appl. No.: 15/450,322

(22) Filed: Mar. 6, 2017

(65) Prior Publication Data

US 2018/0251951 A1 Sep. 6, 2018

(51) Int. Cl.

| | |
|---|---|
| ***E02F 3/76*** | (2006.01) |
| ***E02F 9/22*** | (2006.01) |
| ***E02F 3/84*** | (2006.01) |

(52) U.S. Cl.

CPC ..... *E02F 3/7677* (2013.01); *E02F 3/7663* (2013.01); *E02F 3/844* (2013.01); *E02F 9/2271* (2013.01)

(58) Field of Classification Search

CPC . E02F 3/64; E02F 3/658; E02F 3/6463; E02F 3/651; E02F 3/654; E02F 3/7768; E02F 3/845; E02F 3/7677; E02F 3/844; E02F 3/7663; E02F 3/7672; E02F 9/2271; E02F 9/2275

USPC ..... 37/195, 372, 416, 417, 428; 172/1, 4.5, 172/799.5, 777, 507, 783, 666, 197, 798; 280/5.514, 43.23

See application file for complete search history.

(56) References Cited

U.S. PATENT DOCUMENTS

| | | | | |
|---|---|---|---|---|
| 2,734,293 A | | 2/1956 | Barnes | |
| 3,097,440 A | * | 7/1963 | Schmidt | E02F 3/6463 37/428 |
| 3,776,318 A | | 12/1973 | Layton | |
| 3,866,341 A | * | 2/1975 | Fabrygel | E02F 3/7672 172/406 |
| 4,055,222 A | | 10/1977 | Runte | |
| 4,189,009 A | | 2/1980 | Welch | |
| 4,217,962 A | | 8/1980 | Schaefer | |
| 4,337,833 A | | 7/1982 | Welch | |
| 4,898,247 A | | 2/1990 | Springfield | |
| 5,833,012 A | | 11/1998 | Pierce et al. | |
| 7,284,346 B2 | * | 10/2007 | Miskin | E02F 3/6481 37/195 |

(Continued)

FOREIGN PATENT DOCUMENTS

WO 2016/109882 A1 7/2016

*Primary Examiner* — Robert E Pezzuto

(74) *Attorney, Agent, or Firm* — Thompson Coburn LLP

(57) ABSTRACT

An implement has a frame. First and second shafts are mounted to the frame and rotate along coaxial longitudinal center axes. A tilt actuator is operatively connected between the first and second shafts such that as the tilt cylinder moves from an expanded to a contracted position, it rotates the first shaft in a first direction and the second shaft in an second opposite direction; and from a contracted to an expanded position, it rotates the first shaft in the second direction and the second shaft in the first direction, thereby changing the tilt of the implement. A height actuator is operatively connected between the frame and the tilt actuator and drives the first and second shafts in the same direction to change the height of the implement.

20 Claims, 8 Drawing Sheets

(56) References Cited

U.S. PATENT DOCUMENTS

| | | | | |
|---|---|---|---|---|
| 8,418,777 | B1 | 4/2013 | Grossen | |
| 8,732,993 | B2 | 5/2014 | Hruska et al. | |
| 8,738,242 | B2 | 5/2014 | Konno et al. | |
| 8,944,178 | B1 | 2/2015 | Seal | |
| 9,745,714 | B2 * | 8/2017 | Lubbers | E02F 3/6463 |
| 2013/0284466 | A1 | 10/2013 | Layton | |

* cited by examiner

TILT AND HEIGHT ADJUSTMENT MECHANISM FOR IMPLEMENT

BACKGROUND AND SUMMARY

This disclosure is directed to an implement, for instance, a box landscape scraper. More in particular, the disclosure is directed to a scraper that has one actuator for setting the blade height of the implement and another actuator for controlling the tilt of the implement. The tilt actuator has a first end operatively coupled to a first shaft and a second end operatively coupled to a second shaft. As the tilt actuator moves between expanded and contracted positions, the first and second shafts rotate in opposite directions thereby creating a desired level of tilt of the scraper. The height actuator may independently adjust the height of the blade without changing the amount of tilt. The tilt actuator may independently adjust the amount of tilt of the blade without changing the blade height.

DETAILED DESCRIPTION

Figure 1:
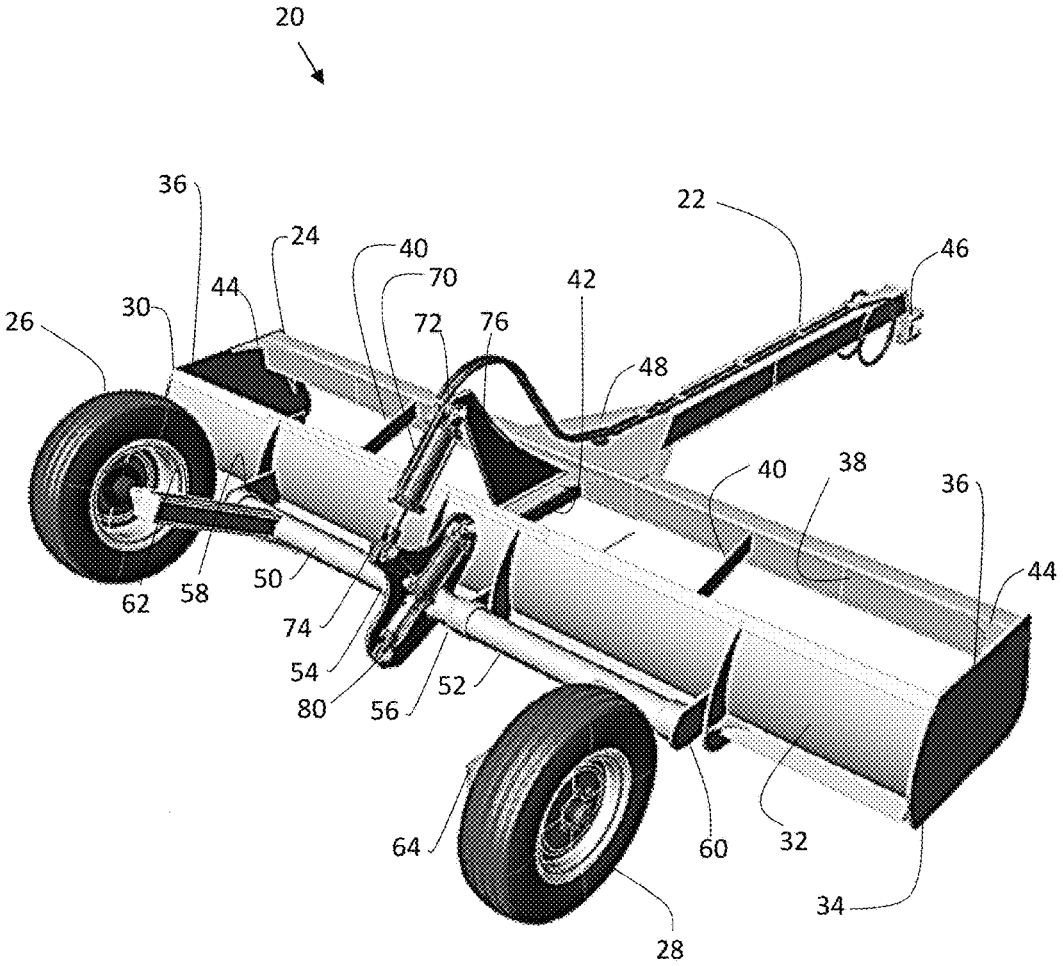
FIG. 1 is a perspective view of an exemplary implement comprising a box scraper.
Figure 2:
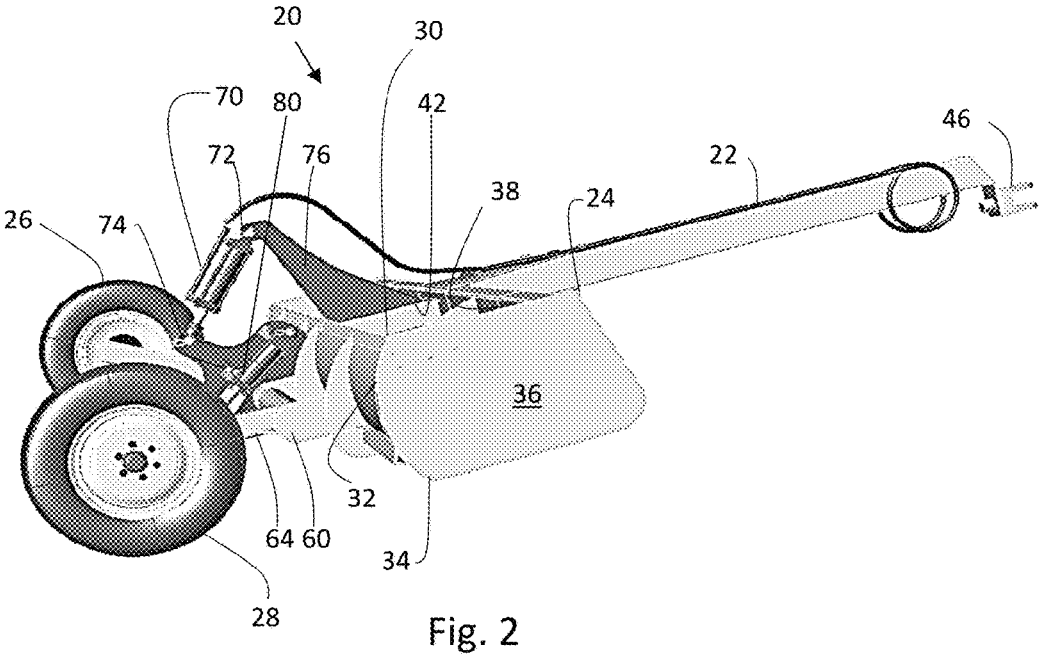
FIG. 2 is an alternative perspective view of the box scraper of FIG. 1.
Figure 3:
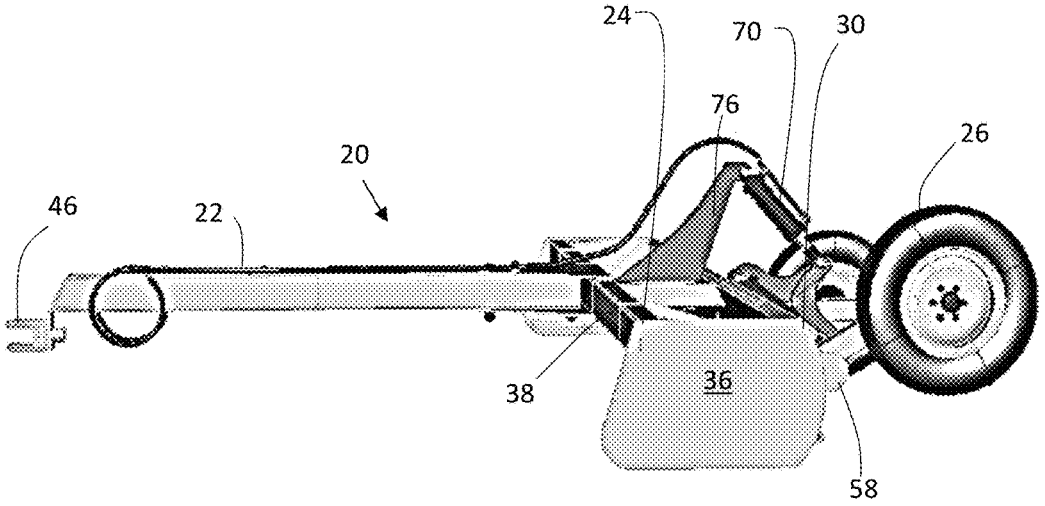
FIG. 3 is an alternative perspective view of the box scraper of FIG. 1.
Figure 4:
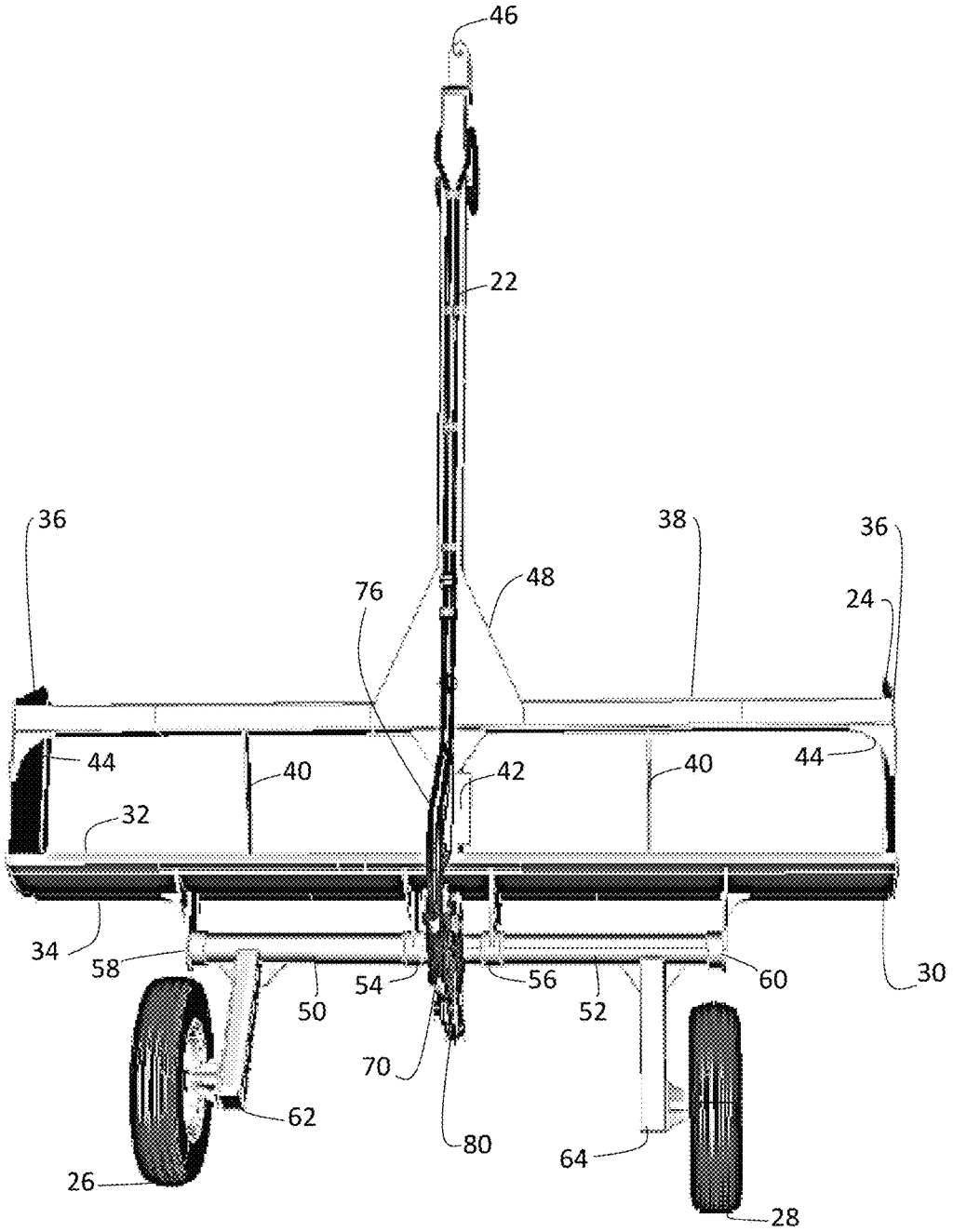
FIG. 4 is a top view of the box scraper of FIG. 1.
Figure 5:
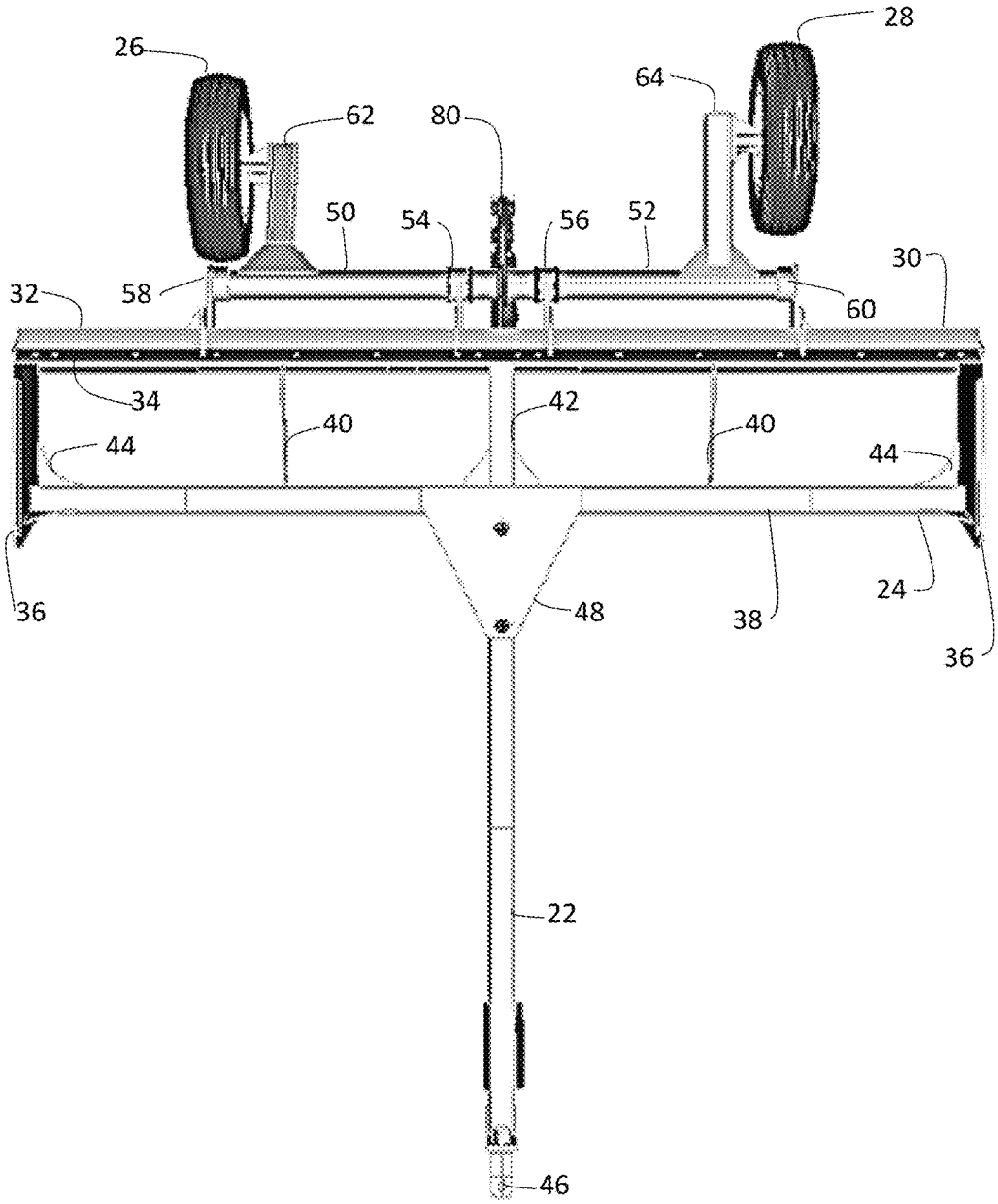
FIG. 5 is a bottom view of the box scraper of FIG. 1.

As used herein, the terms left, right, forward, rearward, inboard, outboard, top, bottom, vertical, horizontal, above, and below are used for the sake of convenience and ease in describing the various features of the embodiments as they appear in the drawings, and the terms are not to be deemed as limiting in any sense. Further, while the drawings show a tow-behind type, box scraper, the principles of the invention may be practiced with other implements.

The exemplary implement comprises a tow-behind, wheeled box scraper 20. The scraper 20 may be towed behind a tractor or other implement with a tow bar 22 extending from a forward end 24 of the box scraper. The box scraper 20 may be supported with left and right wheels 26,28 at the rearward end 30 of the box scraper. The box scraper 20 has a mold board 32 supporting a scraping blade 34 and side panels 36 extending forward from the mold board to contain the scraped material. The mold board 32 and scraper blade 34 may be aligned generally perpendicular to the length of the tow bar 22 and the direction of travel of the box scraper in operation, although in some applications the mold board and/or blade may be adjustably pivoted or angled relative to the tow bar and direction of motion to direct scraped material to one side of the box scraper. Together, the mold board 32, the blade 34, and side panels 36 define an interior of the box scraper. The box scraper 20 has a forward lateral frame member 38 extending generally parallel to the mold board and extending between forward, upper ends of the opposite side panels to provide additional rigidity for the box scraper. Bracing 40 may be provided between the forward lateral frame member 38 and the mold board 32 for additional rigidity. A center brace 42 extending between the tow bar 22 and the mold board 32 may also be provided for additional structural support. Gussets 44 may be provided between the forward lateral frame member 38 and side panels 36, and between the mold board 32 and the side panels 36 to provide additional structural support for the box scraper. The tow bar 22 may extend forward from the forward lateral frame member 38 to enable the box scraper to be towed behind another implement. A conventional hitch 46 may be provided on the distal end of the tow bar to facilitate towing. The tow bar may have a strengthening gusset 48 between the tow bar 22 and the forward lateral frame member 38.

On the rearward facing side of the mold board, a plurality of shaft supports may be provided with left and right cylindrical shafts 50,52 extending in a direction generally parallel to the mold board 32 and generally vertically centered relative to the mold board. To support each of the shafts, there are left and right inboard shaft supports 54,56 and left and right outboard shaft supports 58,60 extending rearward from the face of the mold board 32. The left shaft 50 is rotatably mounted to the left outboard 58 and left inboard 54 shaft supports. The right shaft 52 is rotatably mounted to the right outboard 60 and right inboard 56 shaft supports. Both shafts rotate 50,52 about their respective longitudinal center axes. The center axes of the shafts 50,52 may be transverse to the direction of motion of travel of the implement. The center axes of the shafts may be co-linearly aligned with each other. The shafts 50,52 may be of equal length and centered (e.g., vertically and/or horizontally) on the mold board 32 with their proximal ends terminating in a lateral centerline of the box scraper and/or mold board. The left and right shafts 50,52 extend from the respective outboard shaft supports 58,60 and pass through the inboard shaft supports 54,56 with proximal ends of the shaft adjacent to each other generally at the lateral centerline of the mold board 32. The left and right outboard shaft supports 58,60 may each comprise a cup into which the respective left and right shaft 50,52 is received, providing rotational motion with no axial motion of the shaft relative to the cup. The left and right inboard shaft supports 54,56 may comprise a bushing allowing for rotational motion of the respective shaft relative to the support. The left and right inboard shaft supports 54,56 and/or the left and right outboard shaft supports 58,60 may comprise lubricated bearings to facilitate rotation.

Adjacent to or on distal ends of each of the left and right shafts, adjacent to the respective outboard shaft support, each shaft 50,52 may be provided with an axle member 62,64. The axle member 62,64 may project radially from the shaft 50,52 and support the left and right wheels 26,28 on a distal end of the axle member. The left and right wheels 26,28 may be rotatably coupled to the distal end of the axle member 62,64. While the drawings show one wheel comprising the left and right wheel, multiple wheels may be provided as an axle assembly on the distal end of each axle member. For instance, the left and right wheels may comprise a plurality of left wheels and a plurality of right wheel arranged in sets, by way of example, the right wheel may comprise a right wheel set with one wheel on an inboard side of the axle member and another wheel on an outboard side of the axle member, and the left wheel may comprise a left wheel set with one wheel on an inboard side of the axle member and another wheel on an outboard side of the axle member.

The implement has a height actuator 70 that sets the height of the blade/scraper of the implement. The height actuator has first and second ends 72,74. The height actuator first end 72 may be pivotally mounted to a gusset 76 extending vertically upward from the center brace 42 between the forward lateral frame member 38 and the mold board 32. The second end 74 of the height actuator 70 may be operatively connected to a tilt actuator 80 with first and second pivoting brackets 82,84 as described below. The height actuator 70 may be hydraulic, pneumatic, electric, or manual. Operation of the height actuator 70 will be described in greater detail below.

Figure 6:
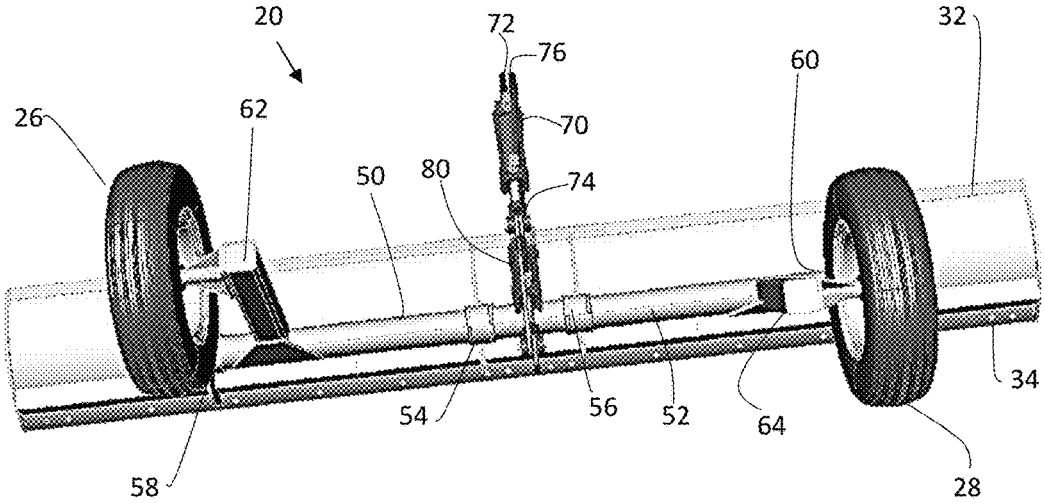
FIG. 6 is a rear view of the box scraper of FIG. 1 showing a leftward leaning tilt.
Figure 7:
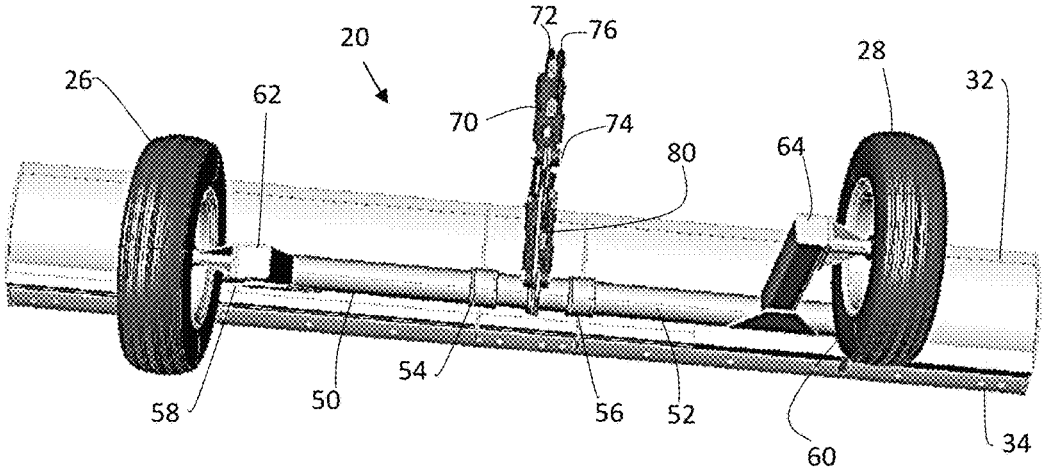
FIG. 7 is an alternate rear view of the box scraper of FIG. 1 showing a rightward leaning tilt.
Figure 8:
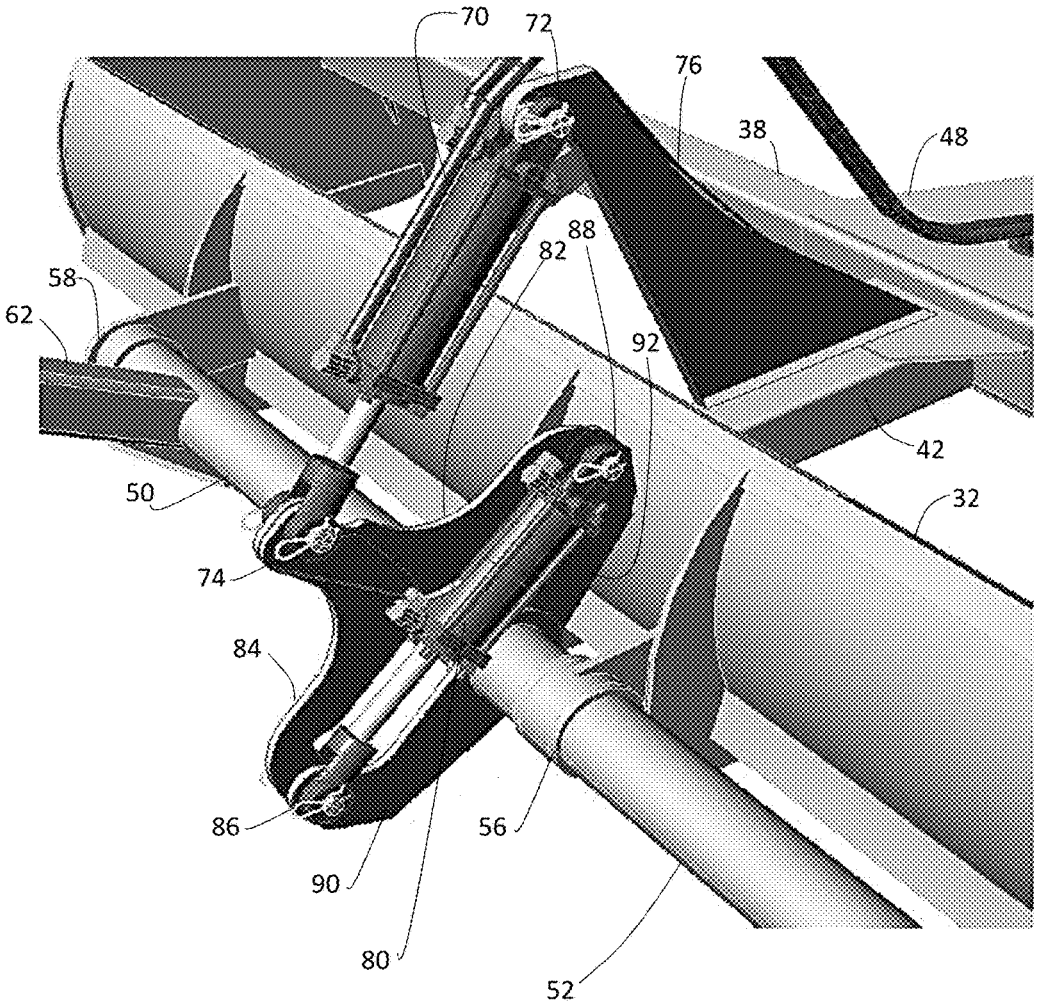
FIG. 8 is a partial, perspective view of a blade height actuator and tilt actuator of the box scraper of FIG. 1, with the tilt actuator in an expanded orientation.
Figure 9:
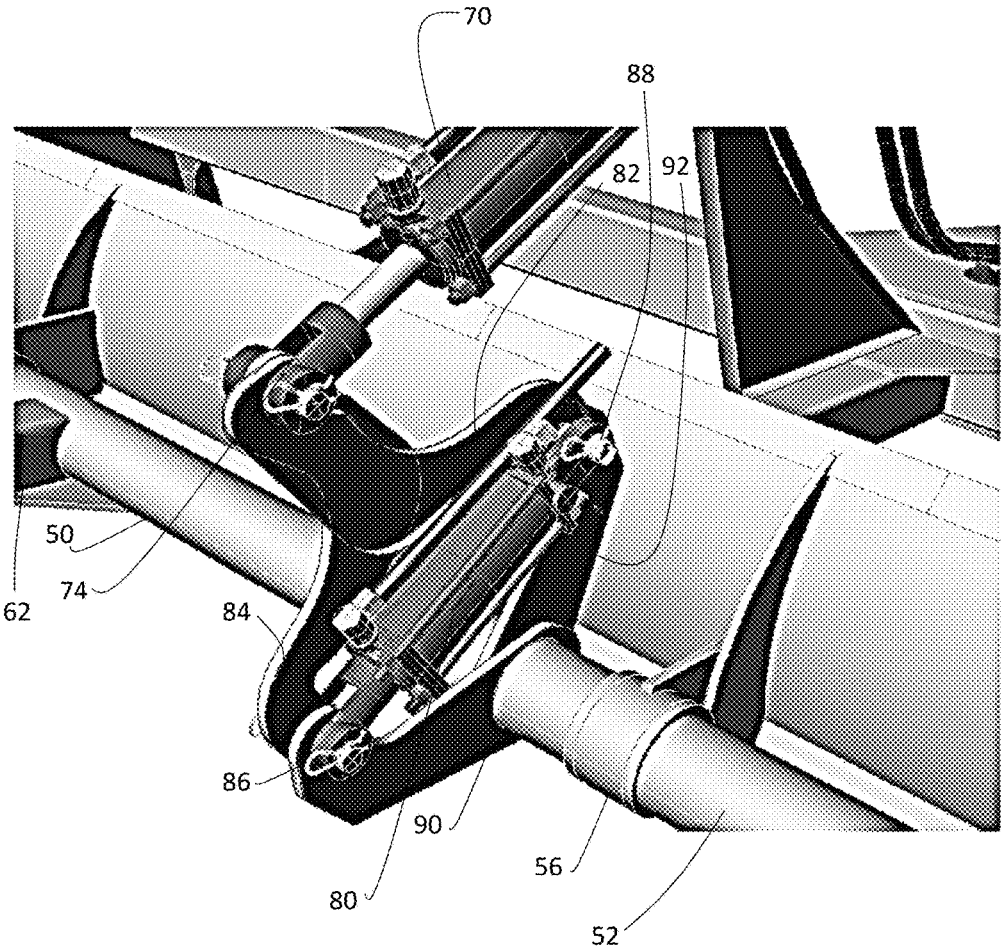
FIG. 9 is a partial, perspective view of a blade height actuator and tilt actuator of the box scraper of FIG. 1, with the tilt actuator in a contracted orientation.
Figure 10:
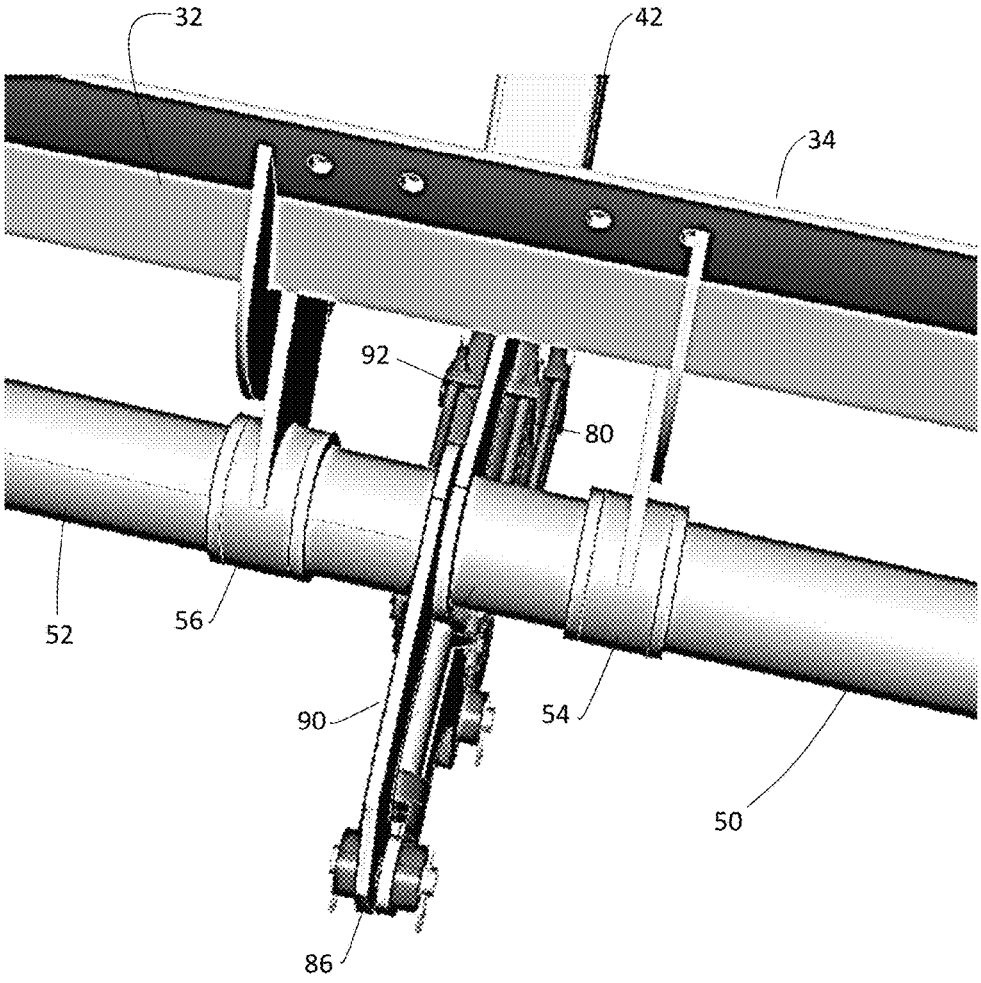
FIG. 10 is a partial, perspective bottom view of a tilt actuator and left and right shafts of the box scraper of FIG. 1.

The tilt actuator 80 sets an amount of tilt of the blade of the implement. As best shown in FIGS. 8, 9, and 10, the tilt actuator 80 may be a linear actuator with opposite first and second ends 86,88. The tilt actuator first end 86 is pivotally connected to a right drive bar 90 extending radially from the right shaft 52 proximal end. The tilt actuator second end 88 is pivotally connected to a left drive bar 92 extending radially from the left shaft 50 proximal end. As the tilt actuator 80 moves between the expanded and contracted positions, the first and second ends 86,88 of the tilt actuator cause opposite rotation of the drive bars 90,92 that in turn generates opposite rotation of the shafts 50,52 about their respective center axes. The opposite rotation of the shafts 50,52 in turn causes opposite rotation of the axle members 60,62 and that in turn changes the position of the wheels 26,28 and wheel height relative to the mold board 32. As the shafts 50,52 rotate in opposite directions, one wheel moves toward and under the mold board 32 to raise that lateral end of the implement (increase wheel height). The other wheel moves out and away from the mold board 32 to lower that lateral end of the implement (decrease wheel height). The effect generates a desired amount of tilt for the blade 34. For instance, when the tilt actuator 80 moves from a contracted position to an expanded position as shown in the FIG. 8, the tilt actuator first end 86 drives the right drive bar 90 in the counter clockwise direction in the drawings, thereby moving the right wheel 28 toward and under the mold board 32 creating an increase in wheel height and causing the relative position of the blade 34 to raise on the right lateral end of the implement. The tilt actuator second end 88 drives the left drive bar 92 in the clockwise direction, thereby moving the left wheel 26 out and away from the mold board 32 creating a decrease in wheel height and causing the relative position of the blade 34 to lower on the left lateral end of the implement left. The overall effect is the tilt shown in FIG. 6. In FIG. 9, the opposite motion is shown with the tilt actuator 80 shown in the contracted position. As the tilt actuator moves from the expanded position to the contracted position, the tilt actuator first end 86 drives the right drive bar 90 in the clockwise direction thereby moving the right wheel 28 out and away from the mold board creating a decrease in wheel height and causing the relative position of the blade 34 to lower on the right lateral end of the implement. The tilt actuator second end 88 drives the left drive bar 92 in the counter clockwise direction thereby moving the left wheel 26 toward to move under the mold board 32 creating an increase in wheel height and causing the relative position of the blade 34 to raise on the left lateral end of the implement left. The overall effect is the tilt shown in FIG. 7. A neutral position of the tilt actuator 80 may provide an equal amount of angular displacement for each shaft 50,52, thereby creating an equal wheel height and no tilt. To affect a desired range of motion, the drive bars 90,92 may have a shape sufficient to generate angular displacement based upon the linear displacement of the tilt actuator 80, and sufficient to generate the torque necessary to drive the shafts 50,52, reposition the wheels 26,28 and provide the desired amount of tilt for the blade 34. The tilt actuator 80 may be hydraulic, pneumatic, electric, or manual. The tilt actuator may be positioned in the center of the implement, and the tilt actuator may be a linear actuator (as shown) or rotary (not shown).

The first and second ends 86,88 of the tilt actuator 80 also provide mounts for the first and second brackets 82,84 of the height actuator 70. As shown in FIGS. 8 and 9, the height actuator second end 74 has the first bracket 82 pivotally connected to the tilt actuator first end 86 and the second bracket 84 pivotally connected to the tilt actuator second end 88. The height actuator first and second brackets 82,84 share a common pivot point with the height actuator second end 74. As the height actuator 70 moves between expanded and contracted positions, it affects rotation of the left and right shafts 50,52 in the same direction, thereby moving the left and right wheels 26,28 together toward or away from the mold board 32 which in turn changes the blade height 34 without changing the amount of tilt provided by the tilt actuator. For instance, when the height actuator 70 is moved to the expanded position, the height actuator second end 74 drives both the left and right drive bars 90,92 in a counterclockwise direction which in turn rotates both shafts 50,52 in the counterclockwise direction. Counterclockwise rotation of both shafts 50,52 causes both wheel assemblies 26,28 to move toward and under the mold board 32 so as to raise the height of the blade 34. When the height actuator 70 is moved to the contracted position, the height actuator second end 74 drives both the left and right drive bars 90,92 in a clockwise direction which in turn rotates both shafts 50,52 in the clockwise direction. Clockwise rotation of both shafts 50,52 causes both wheels 26,28 to move out and away from the mold board 32 so as to lower the height of the blade 34. The pivot mount of the first and second brackets 82,84 to the height actuator second end 74 allows the brackets to move relative to each other thereby enabling the tilt actuator 80 to maintain the desired tilt of the blade 34 while changing the blade height.

The use of a single blade height actuator 70 and a single independent tilt actuator 80 allows the blade 34 of the implement to be tilted in either direction while the blade height stays fixed. The disclosed embodiments allow the implement to be tilted with the separate single tilt actuator without changing the blade height. The disclosed embodiments allow the implement to be lifted with one blade height actuator without changing the tilt angle. The disclosed embodiments allow the implement to generate improved cutting force as the fulcrum point is moved laterally outboard which tends to make the blade more stable when the unit is tilted to extreme angles. The disclosed embodiments allow the blade height actuator and tilt actuators to work together to set an amount of tilt and the blade height. With the axle members extending from the distal ends of the shafts, there is improved weight distribution and stability. The disclosed embodiments eliminate the need to use multiple tilt cylinders at each axle to change the position of the individual axle relative to the mold board.

In view of the foregoing, it will be seen that the several advantages are achieved and attained. The embodiments were chosen and described in order to best explain the principles and the practical application of the embodiments to thereby enable others skilled in the art to best utilize the various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An implement comprising:

a frame;

first and second shafts mounted to the frame for rotation about each shaft's longitudinal axis, the first shaft having a first wheel operatively coupled thereto, the first wheel supporting the frame and defining a first wheel height relative to the frame, the second shaft having a second wheel operatively coupled thereto, the second wheel supporting the frame and defining a second wheel height relative to the frame;

a tilt actuator having first and second ends, the tilt actuator first end being operatively connected to the first shaft, the tilt actuator second end being operatively connected to the second shaft, the tilt actuator being configured to move between expanded and contracted positions;

wherein in moving from the expanded position to the contracted positions, the first and second ends of the tilt actuator move toward each other and drive the respective first and second shafts in opposite rotational directions about their respective longitudinal center axes to increase the first wheel height relative to the frame and decrease the second wheel height relative to the frame;

wherein in moving from the contracted position to the expanded position, the first and second ends of the tilt actuator move away from each other and drive the respective first and second shafts in opposite rotational directions about their respective longitudinal center axes to decrease the first wheel height relative to the frame and increase the second height wheel relative to the frame; and a height actuator having first and second ends, the height actuator first end being operatively connected to the frame, the height actuator second end being operatively connected to the first and second ends of the tilt actuator, the height actuator being configured to move between expanded and contracted positions;

wherein in moving from the expanded position to the contracted positions of the height actuator, the first and second ends of the height actuator move toward each other and drive the respective first and second shafts in the same rotational direction about their respective longitudinal center axes to change the first wheel height relative to the frame and change the second wheel height relative to the frame in a first direction; and wherein in moving from the contracted position to the expanded position of the height actuator, the first and second ends of the height actuator move away from each other and drive the respective first and second shafts in the same rotational directions about their respective longitudinal center axes to change the first wheel height relative to the frame and change the second height wheel relative to the frame in a second direction opposite the first direction.

2. The implement of claim 1 further comprising first and second drive bars extending radially from respective first and second shafts, and the tilt actuator first end is pivotally connected to the first drive bar and the tilt actuator second end is pivotally connected to the second drive bar.

3. The implement of claim 1 further comprising first and second axle members extending radially from respective first and second shafts, and the first wheel is rotatably connected to the first axle member and the second wheel is rotatably connected to the second axle member.

4. The implement of claim 3 wherein the first and second wheels comprise a plurality of first and second wheels rotatably connected to the respective axle member.

5. The implement of claim 1 further comprising first and second height actuator mounting brackets, the first height actuator mounting bracket being pivotally connected to the height actuator second end and the tilt actuator first end, the second height actuator mounting bracket being pivotally connected to the height actuator second end and the tilt actuator second end.

6. The implement of claim 1 further comprising a box scraper.

7. An implement comprising:

a frame;

a first shaft rotatably mounted to the frame;

a second shaft rotatably mounted to the frame;

a first wheel operatively connected to the first shaft and supporting the frame;

a second wheel operatively connected to the second shaft and supporting the frame;

a tilt actuator having first and second ends, the tilt actuator first end being operatively connected to the first shaft, the tilt actuator second end being operatively connected to the second shaft, the tilt actuator being configured such that movement of the tilt actuator from (a) an expanded position to the contracted position generates: (i) rotation of the first shaft to move the first wheel out and away from the frame and (ii) rotation of the second shaft to move the second wheel toward and under the frame; and (b) a contracted position to an expanded position generates: (iii) rotation of the first shaft to move the first wheel toward and under the frame and (iv) rotation of the second shaft to move the second wheel out and away from the frame; and a height actuator having first and second ends, the height actuator first end being operatively connected to the frame, the height actuator second end being operatively connected to the first and second ends of the tilt actuator, the height actuator being configured to move between expanded and contracted positions;

wherein in moving between the expanded position to the contracted positions of the height actuator, the first and second ends of the height actuator move (a) toward each other and drive the respective first and second shafts in the same rotational direction about their respective longitudinal center axes to move the first and second wheels out and away from the frame; and (b) away from each other and drive the respective first and second shafts in the same rotational directions about their respective longitudinal center axes to move the first and second wheels toward and under the frame.

8. The implement of claim 7 further comprising first and second drive bars extending radially from proximal ends of respective first and second shafts, and the tilt actuator first end is pivotally connected to the first drive bar and the tilt actuator second end is pivotally connected to the second drive bar.

9. The implement of claim 8 further comprising first and second axle members extending radially adjacent to distal ends of respective first and second shafts, and the first wheel is rotatably connected to the first axle member and the second wheel is rotatably connected to the second axle member.

10. The implement of claim 9 wherein the first and second wheels comprise a plurality of first and second wheels rotatably connected to the respective axle member.

11. The implement of claim 9 further comprising first and second height actuator mounting brackets, the first height actuator mounting bracket being pivotally connected to the height actuator second end and the tilt actuator first end, the second height actuator mounting bracket being pivotally connected to the height actuator second end and the tilt actuator second end.

12. The implement of claim 7 wherein the first and second shafts extend laterally across the frame perpendicular to a direction of travel of the implement when in normal operation.

13. The implement of claim 7 wherein the first and second shafts are disposed between the frame and the wheels.

14. The implement of claim 7 wherein the tilt actuator comprises a linear actuator.

15. The implement of claim 7 wherein the height actuator comprises a linear actuator.

16. An implement comprising:

a frame;

first and second shafts mounted to the frame and configured for rotation relative to the frame along longitudinal center axes of the first and second shafts, the first and second shafts being co-axially aligned with respect to each other;

a first wheel operatively connected to the first shaft and supporting the frame;

a second wheel operatively connected to the second shaft and supporting the frame;

a tilt actuator having first and second ends, the tilt actuator first end being operatively connected to the first shaft, the tilt actuator second end being operatively connected to the second shaft, the tilt actuator being configured such that movement of the tilt cylinder from (a) an expanded position to the contracted position generates: (i) rotation of the first shaft in a first rotational direction and (ii) rotation of the second shaft in a second rotational direction wherein the first rotational direction is opposite to the second rotational direction; and (b) a contracted position to an expanded position generates: (iii) rotation of the first shaft in the second rotational direction and (iv) rotation of the second shaft in the first rotation direction; and a height actuator having first and second ends, the height actuator first end being operatively connected to the frame, the height actuator second end being operatively connected to the first and second ends of the tilt actuator, the height actuator being configured to move between expanded and contracted positions;

wherein in moving from the expanded position to the contracted positions of the height actuator, the first and second ends of the height actuator move toward each other and drive the respective first and second shafts in the first rotational direction; and wherein in moving from the contracted position to the expanded position of the height actuator, the first and second ends of the height actuator move away each other and drive the respective first and second shafts in the second rotational direction.

17. The implement of claim 16 further comprising first and second drive bars extending radially from proximal ends of respective first and second shafts, and the tilt actuator first end is pivotally connected to the first drive bar and the tilt actuator second end is pivotally connected to the second drive bar.

18. The implement of claim 17 further comprising first and second axle members extending radially adjacent to distal ends of respective first and second shafts, and the first wheel is rotatably connected to the first axle member and the second wheel is rotatably connected to the second axle member.

19. The implement of claim 18 further comprising first and second height actuator mounting brackets, the first height actuator mounting bracket being pivotally connected to the height actuator second end and the tilt actuator first end, the second height actuator mounting bracket being pivotally connected to the height actuator second end and the tilt actuator second end.

20. The implement of claim 18 wherein the tilt actuator and height actuator are arranged in a center of the frame.

* * * * *